United States Patent [19]

Da Costa

[11] 4,316,337

[45] Feb. 23, 1982

[54] ILLUMINATED DISPLAY ASSEMBLY

[76] Inventor: Daniel D. Da Costa, 186 Lymington Rd., Torquay, Devon, England

[21] Appl. No.: 128,925

[22] Filed: Mar. 10, 1980

[30] Foreign Application Priority Data

Mar. 16, 1979 [GB] United Kingdom ..... 09438/79

[51] Int. Cl.[3] ..... G09F 13/04

[52] U.S. Cl. ..... 40/564; 40/152.2

[58] Field of Search ..... 40/594, 615, 158, 564, 40/158 B, 564

[56] References Cited

U.S. PATENT DOCUMENTS

| | | | |
|---|---|---|---|
| 1,410,130 | 3/1922 | Sinclair | 40/158 B |
| 2,556,779 | 6/1951 | Ross | 40/564 |
| 2,586,039 | 2/1952 | Heggedai | 40/594 |
| 2,845,734 | 8/1958 | Brady | 40/158 |
| 2,896,351 | 7/1959 | Johnson | 40/594 |
| 2,906,047 | 9/1959 | Cooke | 40/152.2 X |
| 3,431,666 | 3/1969 | Bank | 40/615 |

*Primary Examiner*—Gene Mancene
*Assistant Examiner*—Wenceslao J. Contreras
*Attorney, Agent, or Firm*—Irvin A. Lavine

[57] ABSTRACT

A display device which is provided with one or more opaque display frames for mounting information to be displayed. The or each display frame is provided with one or more transparent areas at which display members containing selected information for display are detachably secured. The display members are opaque with the exception of the information contained thereon to block-off light passing through the transparent areas but not through the information on the members so that the opaque masking effect produced enhances the display to an observer when the display device is suitably illuminated.

8 Claims, 5 Drawing Figures

ILLUMINATED DISPLAY ASSEMBLY

TECHNICAL FIELD OF THE INVENTION

The present invention relates to a display device comprising one or more display frames for mounting information to be displayed under illumination.

BACKGROUND ART

It is known for example, to display photographs of property for sale, either using photographic prints or coloured transparencies, by mounting the photograph or colour transparency in front of a light source to highlight the scene depicted.

However under normal conditions the light surrounding the photograph or transparency causes an unflattering effect, and additionally any messages relating to the scene depicted have to be arranged on a separate display. In all, this method of displaying information lacks refinement and does not advertise the subject matter being displayed to the best advantage.

DISCLOSURE OF THE INVENTION

It is an object of the invention to provide a display device for displaying selected information such as a photographic scene and printed matter relating thereto in a single array, and to the best possible advantage under illumination. It is a further object of the invention to provide a display device in which it is possible to readily exchange information being displayed by a variety of easy and uncomplicated procedures.

According to the invention there is provided a display device comprising one or more opaque display frames comprising one or more display frames each having a front viewing side and a rear side for receiving illuminating light; one or more transparent portions provided on the or each display frame; a display member containing selected information for display detachably secured to the or each display frame at one or more of said transparent portions thereof, said display member being opaque to block-off its associated transparent portion to the transmission of light, with the exception of the information thereon, whereby when said rear face is under illumination light is transmitted solely through said information and is enhanced to an observer of said front side by the masking effect of the surrounding opacity of the or each display frame and the associated display member.

With this arrangement of display device according to the invention, the information displayed stands out more clearly to an observer due to the light blocking effect of the opaque frame arond the illuminated information.

This is especially apparent when displaying a photographic scene in combination with information relating thereto, and not withstanding the possible poor quality of the scene depicted which otherwise would mar the whole effect. Moreover the information describing the scene depicted does not have to be arranged on a separative display, and its content can be selected as desired and placed at the mounting positions provided. Such content can be made up word by word or letter by letter thus endowing the display with considerable versatility in terms of the variation of information which can be shown.

One side of the or each display frame may be provided with a layer of adhesive material such as limp PVC, so that information in whatever form it is presented, can be readily attached and removed to be exchanged for different information when desired. A variety of messages may thus be readily and interchangeably presented using the display device of the present invention.

The printed information may be in the form of strips of photographic negative containing exposed whole words, parts of words or letters or complete messages. This again adds versatility of the device because the variety of the information which can be displayed is increased.

The strips are attached at the transparent areas and will normally correspond at least in size to the size of these clear areas. Those parts of the strips around the written words, letters or messages will of course be opaque to light so that no light is transmitted through the clear areas when the strips are in position, with the exception of light passing through the written information itself. Additionally by providing the strips with extended opaque end portions, a one line message for example, may be formed in an appropriate clear area from several strips by overlapping the opaque end portions of the strips as necessary thus ensuring that no light is transmitted between the strips. Further, separate pieces of opaque strip may be provided, not containing information, for filling in those clear areas of a display frame not required for a particular display, or any portions in a clear area containing a message, and which have not been completely filled by the relevant strip bearing the message.

If white light is used to illuminate the display device from one side, coloured acetate strips can be pressed onto the adhesive backing and over the mounting positions, so that the information displayed is coloured. This additionally enhances the display and provides a pleasing and flattering effect to an observer.

Acetate sheets of differing colours can be laid over one another and pressed in turn onto the adhesive backing, to vary the colour emitted from the display device under illumination. With this arrangement of course the acetate sheets will normally be of varying sizes so that the uppermost sheet extends beyond the boundary of the sheet beneath it whereby it can be pressed into position on the adhesive backing of the frames.

BRIEF DESCRIPTION OF THE DRAWINGS

Embodiments of the invention will now be described by way of example with reference to the accompanying drawings wherein.

BEST MODES OF CARRYING OUT THE INVENTION

Figure 1:
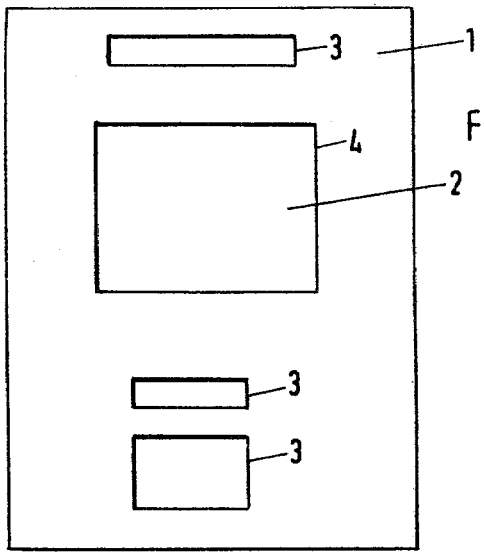
FIG. 1 shows one form of display device for displaying property for sale according to the invention.

The display device according to the embodiment shown in FIG. 1 comprises a mounting frame 1 providing a surround for a scene 2 such as a photographic print or transparency mounted to the frame.

The frame 1 is opaque to light with the exception of the area occupied by the scene 2 so that when a light source (not shown) is positioned behind the frame 1 the photographic scene or transparency 2 is masked by the frame 1 to thereby enhance the photograph and provide a more flattering effect to the display.

The frame 1 is also provided with other areas 3 which are also not opaque to the light being emitted from the light source behind the frame 1.

The non-opaque areas 3 are provided for displaying printed messages relating to the scene 2 being depicted on the display device.

In the embodiment shown in FIG. 1 the mask 1 is a photographic negative exposed in the areas 3 and the area 4 against which the scene 2 is mounted for observation from the front of the display device.

The printed messages are prepared in strips of photographic negative corresponding normally in size to the clear areas 3, and are attached to the rear of the mounting frame 1, such as by cellotape, for observation through the exposed areas 3. Alternatively the printed messages could be in reverse print onto clear acetate. The strips are of course opaque to light arond the written information contained thereon so that no light can pass through the clear areas, apart from that passing through the written information, under illumination.

With the display device set up in this manner and light shining on the display device from the rear thereof, the scene 2 is enhanced by the masking effect of the surround of the frame 1 and the printed messages are readable and eye-catching.

Figure 4:
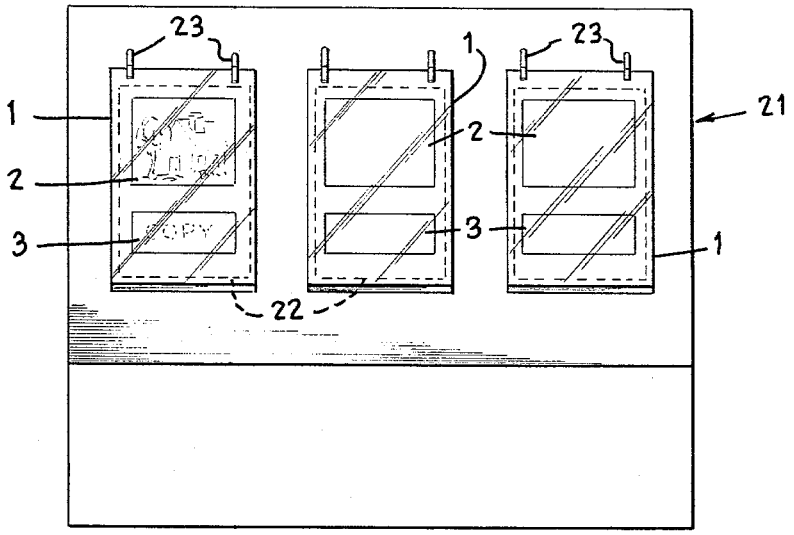
FIG. 4 is an elevational view of a cabinet structure in association with display devices in accordance with the present invention.
Figure 5:
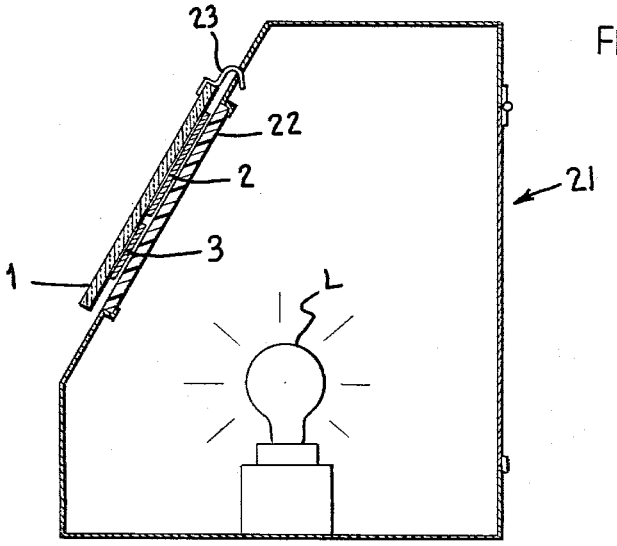
FIG. 5 is a cross-sectional view taken on the line 5—5 of FIG. 4.

The light source, as shown in FIGS. 4 and 5, may be an illuminated cabinet 21. The mounting frame 1 with the scene 2 and printed messages appearing in the area 3, are placed directly onto an acrylic or glass surface 22 on the cabinet 21 and in front of the light source L which acts as a light diffuser.

The mounting frame 1 may be attached to the cabinet in any convenient way such as for example by attaching hooks 23 to the mounting frame 1 for hooking onto convenient positions on the illuminated cabinet 21.

Instead of using a photographic print as the mounting frame, the mounting frame could be made from clear stiff plastics sheeting or glass treated to provide the effect desired such as leaving a clear portion for the scene to be displayed by being printed in reverse block form with the messages relating to the scene also printed in reverse block form.

Figure 3:
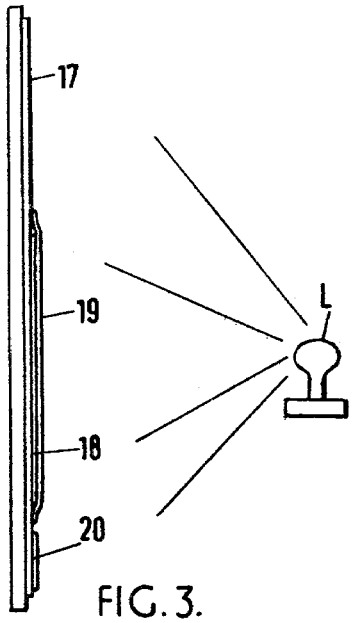
FIG. 3 shows a side view of the display device of FIG. 2.
Figure 2:
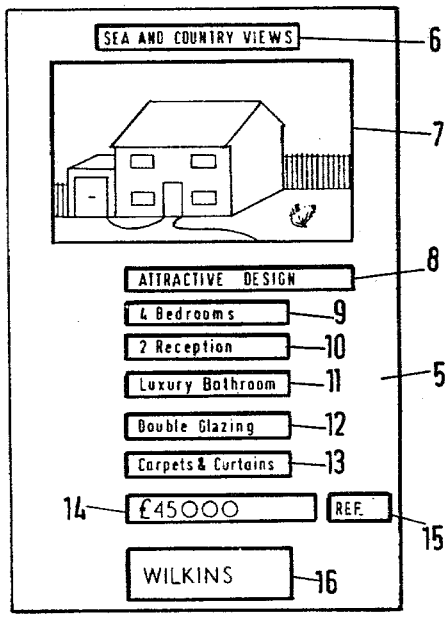
FIG. 2 shows a front view of a display device according to another embodiment of the invention.

Another embodiment of the invention is shown in FIGS. 2 and 3, and this illustrates the manner in which the display device can be used for displaying property for sale.

The display arrangement shown in FIGS. 2 and 3 comprises a mounting frame 5 made of clear acrylic sheeting, and thick enough to render the frame stiff. The acrylic frame 5 is made opaque to light by any suitable treatment and preferably so that the surfaces have a matt black finish. Other colours for the masking surface may be used. For example blue and brown would be very suitable.

Areas 6 to 16 are left clear to provide suitable mounting positions for selected information to be displayed. The content of such selected information is more-or-less infinitely variable and an example of a suitable selection is shown in position 6, and 8 to 16. This information describes the property to be sold shown in position 7.

The side view of the display unit of FIG. 2, shown in FIG. 3, illustrates how the information may be removably attached to the rear of the frame 5. Specifically a layer 17 comprising an adhereably attractive material such as limp PVC, is attached to the frame 5 as shown.

If is is required that the information in positions 6 to 16 be illustrated in colour then layers of coloured acetate 18, 19 and 20 are positioned on the adhesive layer 17. The colours may vary thus providing any shade as desired. In the example shown layers 18 and 19 are blue and yellow such that any information displayed will appear green under white light illumination from light source L. Layer 20 on the other hand is red. The pleasing effect to an observer of the display unit with such a combination of colours will be readily appreciated. Moreover the acetate layers have the effect of reducing glare from the light.

The written information shown in FIG. 3 is provided by strips of printed negative corresponding in size to the clear areas and providing border zones around the information opaque to light. The printed negative strips can be readily attached and removed from the adhesive layer 17 adding considerable versatility to the usefulness of the display device as already mentioned. The messages on the strips such as property details in the present example, can be made up by words or letter by letter, and attached to the display frame by overlapping opaque end portions which may be provided on the strips. Alternatively a complete message eg. 13 FIG. 2, can be placed in the clear area provided, the strip bearing the message corresponding in size to the size of the clear area 13, so that once in place no light is transmitted through the clear area with the exception of that through the written message. The system as described has a variety of commercial applications such as advertising property for sale, staff for hire, travel facilities, and in restaurants, shops and offices.

Specifically considering its use as an advertising display for property for sale, an estate agent could be supplied with a kit of display frames or masks according to the invention, printed on glass or acrylic or other clear material or with a mask made from an opaque material with clear areas possibly formed by cut-outs in the opaque material, together with a suitable library of words, phrases and numerals to thus make up a very attractive window display as required.

When more than one display frame of the display device according to the invention is employed, then the light source for illuminating the display frames may be mounted in a box, one wall of which has cut-outs undersized with respect to the display frames, the cut-outs being filled with pearl acrylic to act as a light diffuser. The frames could then be mounted by hooks to the wall of the box and over the pearl acrylic filling the cut-outs. There must be no light surrounding the display or masking frames and this can be achieved by forming the cut-outs in sheet steel or any other suitable material.

It will be appreciated to those skilled in the art that various departures from the embodiments herein disclosed are possible within the broader aspects of the inventive concept. For example, as already mentioned, the information may be attached to the display frame by cellotape. Other methods of mounting the information will be readily apparent to a person skilled in the art.

I claim:

1. A display device comprising a display frame having a front viewing side and a rear side for receiving illuminating light; said display frame being opaque and having plural transparent portions provided for the transmission of light through said transparent portions of the display frame; a display member containing selected information for display detachably secured to the display frame at each of said transparent portions thereof, said display members being opaque to block-off the associated transparent portion of the frame to the transmission of light, with the exception of the information thereon, the information on at least one of the display members being non-opaque, a backing layer of adhereably attractive material attached to said rear side of the display frame to which can be removably attached said display members, and a sheet of translucent coloured material positioned on said backing layer behind at least one of said display members, whereby when said rear face is under illumination light is transmitted solely through said information and is enhanced to an observer of said front side of the masking effect of the surrounding opacity of the display frame and the associated display member.

2. A display device as claimed in claim 1 wherein a further sheet of acetate is superimposed on said backing layer and over said coloured sheet of acetate, and being of a different colour.

3. A display device as claimed in claim 1 wherein the or each display frame is formed from a sheet of clear acrylic which is made opaque over its entire surface with the exception of said transparent portions.

4. A display device as claimed in claim 1 wherein said display member is in the form of a strip of photographic negative.

5. A display device as claimed in claim 1 wherein said display member is in the form of a strip of clear acetate with the information in reverse print thereon.

6. A display device as claimed in claim 4 or 5 wherein said strips are individual letters of the alphabet.

7. A display device as claimed in claim 6 said strips have extended opaque border portions so that different strips bearing selected words or letters can be laid in overlapping formation at said mounting positions.

8. A display device as claimed in claim 1 wherein a plurality of said display frames are removably mounted over cut-outs in a wall of a box display formed of sheet steel, the cut-outs being filled with pearl acrylic sheets to form a light diffuser for light emitted by light means mounted within the box display.

* * * * *